United States Patent [19]

Lener

[11] 4,003,362

[45] Jan. 18, 1977

[54] FIREPLACE

[76] Inventor: Joseph H. Lener, Rte. 2, Box 252, Grantsburg, Wis. 54840

[22] Filed: June 19, 1975

[21] Appl. No.: 588,188

[52] U.S. Cl. ..... 126/121; 126/288

[51] Int. Cl.[2] ..... F24B 7/02

[58] Field of Search ..... 236/51; 126/121, 288, 126/293, 131, 286, 122

[56] References Cited

UNITED STATES PATENTS

| | | | |
|---|---|---|---|
| 1,681,449 | 8/1928 | Walters | 126/121 |
| 3,096,754 | 7/1963 | Howrey et al. | 126/121 |
| 3,888,231 | 6/1975 | Galluzzo et al. | 126/121 |

*Primary Examiner*—John J. Camby
*Assistant Examiner*—Larry I. Schwartz
*Attorney, Agent, or Firm*—Burd, Braddock & Bartz

[57] ABSTRACT

A fireplace is situated in the wall of a room of a mobile home. It includes a firebox open to the interior of the room and connected to a stack outside of, and spaced from the room. Casing means surrounds the firebox and provides an outer passageway around the outside of the firebox and an inner passageway between the outer passageway and the firebox. Heat from combustion in the firebox induces air flow from outside the room through the inner passageway, around the firebox and into the room to heat the room and to supply air for further combustion. Such combustion heat also induces air flow from outside the room, through the outer passageway to outside of the structure, thereby tending to cool the exterior of fireplace.

8 Claims, 8 Drawing Figures

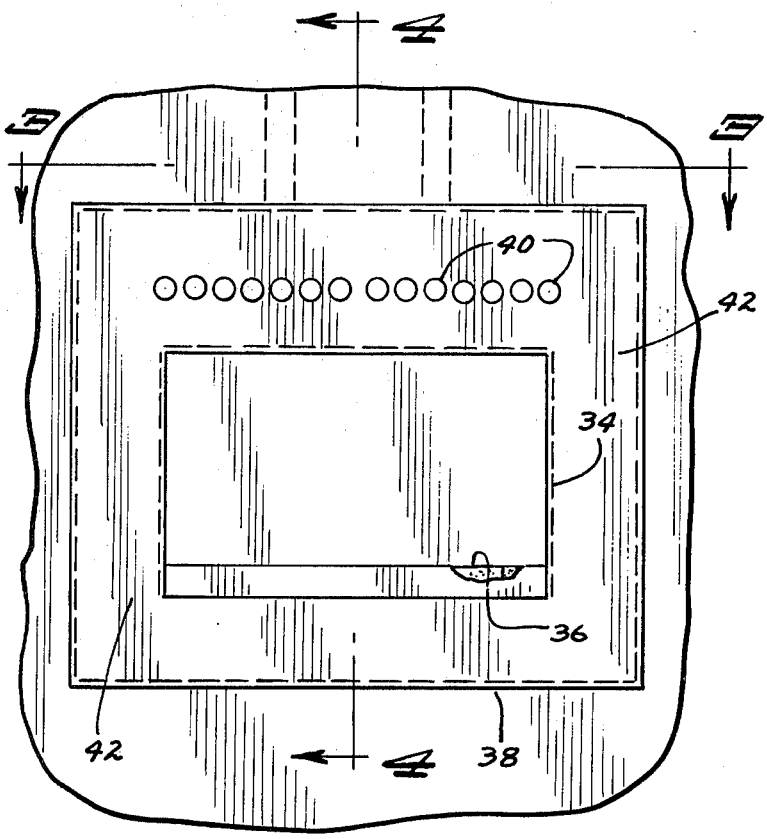
FIG. 2
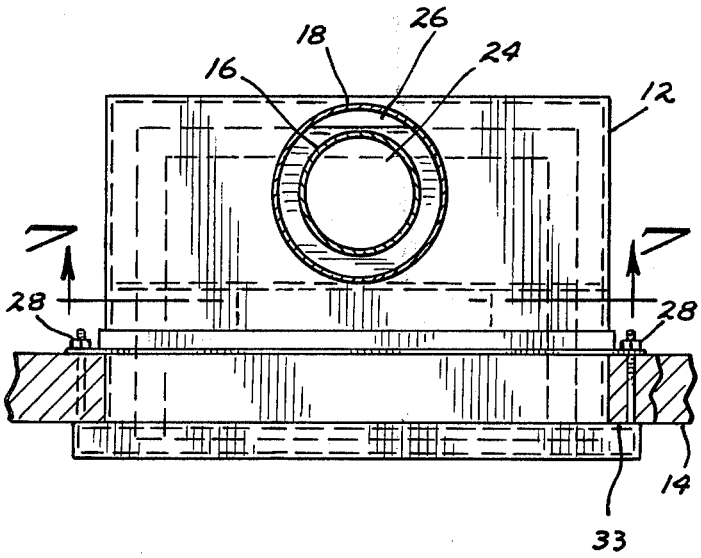
FIG. 3
FIG. 1
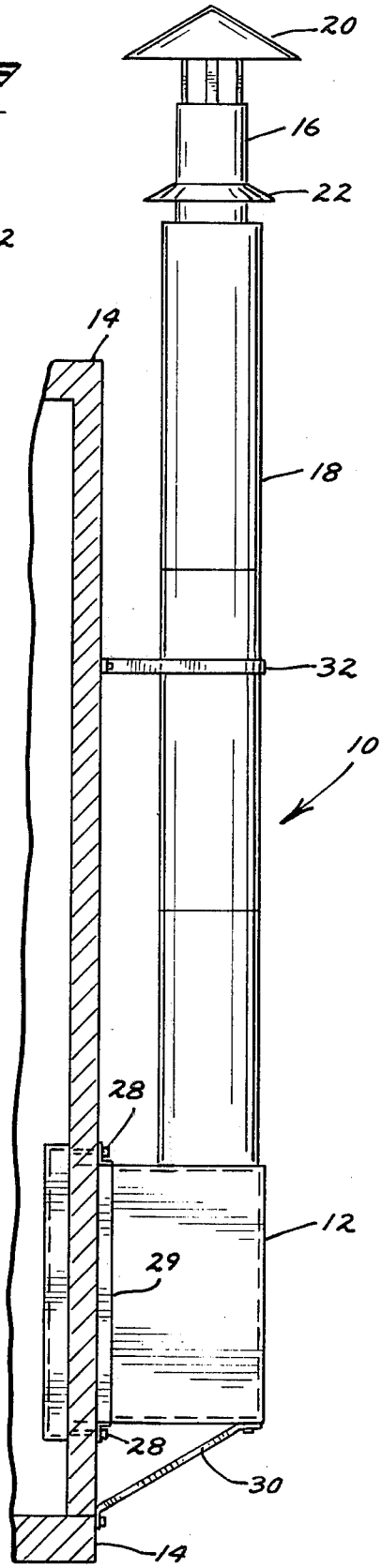

FIREPLACE

BACKGROUND OF THE INVENTION

Use of fire to heat the interior of a structure is one of the oldest practices known to man. One of the earliest refinements of this practice took place in Europe in the fifteenth century: the introduction of a flue or chimney so that the heated, rising air would draw smoke out of the structure.

The present conventional fireplace still utilizes a flue or chimney, which is often mounted in an exterior wall of the heated structure. Wall mounting of the fireplace and chimney requires the use of bricks, masonry, or other insulating materials to prevent damage to the wall.

For a number of reasons, the conventional wall mounted, masonry, fireplace is impractical for use in smaller structures such as mobile homes. The heat insulating material required for protection of walls would add cumbersome weight to the structure. Also, in a mobile home, where space is at a premium, the mere size of the conventional fireplace is a hindrance to its installation and use. Furthermore, movement of combusted gases out of the structure through the chimney creates a partial vacuum within the structure. To replace the oxygen burned up in the firebox, cold outside air must then leak into the structure, causing drafts around doors and windows. Smaller structures are especially susceptible to this problem.

Attempts have been made to use air flow over a fireplace firebox to reduce or eliminate the need for masonry. See, for example, U.S. Pat. Np. 2,821,975 to Thulman, granted Feb. 4, 1958, in which air enters an outer chamber at the top of the smokestack, flows downward and around the fireplace, and leaves through an inner chamber surrounding the stack. This tends to cool the outside surface of the fireplace, reducing the need for heat insulating materials. The technique is also seen in U.S. Pat. No. 3,601,117 to Carson, granted Aug. 24, 1971.

There have been attempts to increase the efficiency of the conventional fireplace by generating a flow of heated air into the room. U.S. Pat. No. 3,190,279 to Davis, granted on June 22, 1965, shows room air entering a chamber below the firebox, proceeding upward in the chamber along the sides of the firebox, and finally flowing back into the room. Of course, this will not counteract the tendency of combustion to form a partial vacuum within the structure, and does not provide replacement oxygen.

Attempts to solve the vacuum problem are seen in U.S. Pat. No. 3,094,980 to Inabnit granted on June 25, 1963, and in U.S. Pat. No. 3,096,754 to Howrey, granted July 9, 1963. Inabnit utilizes fans to draw air downward through a chamber which surrounds the smokestack, and into the structure. This air will tend to cool the stack, become heated due to its proximity to the stack, and consequently tend to heat the room when it is released to the room. In Howrey, air enters from the room into a chamber surrounding the firebox and is expelled back into the room, thereby serving a dual purpose of cooling the exterior surface of the firebox and heating the room. In addition, combustion air may be supplied through an auxiliary line which connects the firebox directly to the outside of the structure. Thus, the principal use shown for outside air is to supply oxygen for combustion.

BRIEF SUMMARY OF THE INVENTION

This invention relates to a combustion type heating unit for a closed structure, said heating unit being particularly suited for mounting in an exterior wall of said structure, though adaptable to other forms of installation. Wall mounting, even after a structure has been completed, is made relatively simple due to the fact that the smokestack or flue portion can be located entirely outside of the structure.

The heating unit assembly of the invention includes a firebox wherein combustion takes place, and casing surrounding the firebox. Two passageways are provided by the casing, proximate to the firebox, and separated from each other. The passageways are placed in such a manner that heat of combustion in the firebox will induce thermosyphonic flow of air through them.

The first or inner passageway communicates with the outside of said structure and with the inside of said structure. Heat due to combustion within the firebox will draw air from outside of the structure, through said inner passageway where it is heated and then to the interior of the structure. This air is heated as it passes adjacent to the walls of the firebox and thus provides heat to the interior of the structure by convection which significantly adds to the fireplace heat normally occurring through radiation. In addition, this air flow provides a steady source of fresh air into the structure, and assures that the air pressure within the structure is substantially the same as that outside.

The heat of combustion in the firebox induces a second flow of air from outside, through the second or outer passageway, and finally to return to the outside of structure. This flow of air serves to cool the exterior portions of the heating unit.

The two air flows take place simultaneously and are the result of the natural tendency of air to rise when it becomes heated. Therefore, no fans or other mechanical aids are necessary.

BRIEF DESCRIPTION OF THE DRAWINGS

FIG. 1 is a side elevational view of a heating unit assembly of the invention in installed relation to a wall of a closed structure;

FIG. 2 is a front view showing the face of the heating unit of FIG. 1 and an interior surface of a portion of said wall;

FIG. 3 is a cross sectional view as seen along line 3—3 of FIG. 2;

DESCRIPTION OF PREFERRED EMBODIMENT

Figure 5:
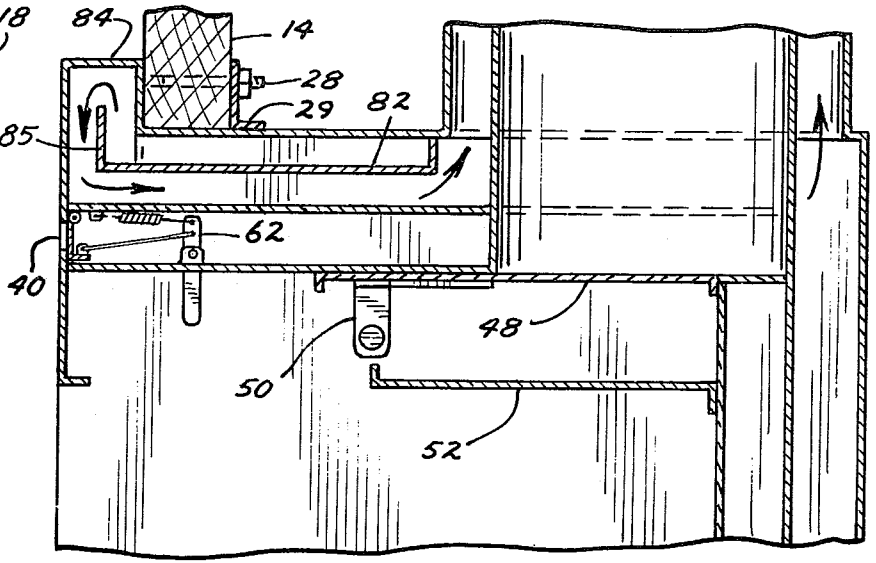
FIG. 5 is a fragmentary view showing a portion of FIG. 4 but with the parts in a different position.

A heating unit assembly 10 includes a heating unit 12 which is mounted in a wall 14 of a mobile home or other closed structure. A stack 16 extends upwardly from the heating unit 12 and also forms a part of the heating unit assembly. A stack casing 18 extends upwardly from the heating unit 12 and concentrically surrounds stack 16. A cap 20 and a shield 22 on the stack substantially prevents rainfall from entering a flue 24 defined by the stack and the space between the stack and the stack casing which forms a part of an outer passageway 26. Bolts 28 extend through a rectangular angle iron flange or collar 29 to secure the heating unit 12 to wall 14. A brace 30 abuts wall 14 and supports a substantial portion of the weight of the heating unit assembly 10. Additional stability is provided by collar and bracket 32 which join stack casing 18 and wall 14.

As perhaps best seen in FIGS. 1 and 3, the heating unit assembly 10 is mounted so that it is substantially outside of the mobile home, by the simple expedient of cutting or otherwise providing a rectangular opening in the wall 14 of the mobile home, and sliding the heating unit 12 through it from the inside until an outer casing flange 33 of the heating unit is in contact with the wall 14. Bolts 28 extend integrally outwardly from the outer casing flange, the rectangular outer angle iron flange 29 is put in place over the bolts, and fastened with appropriate nuts.

Figure 8:
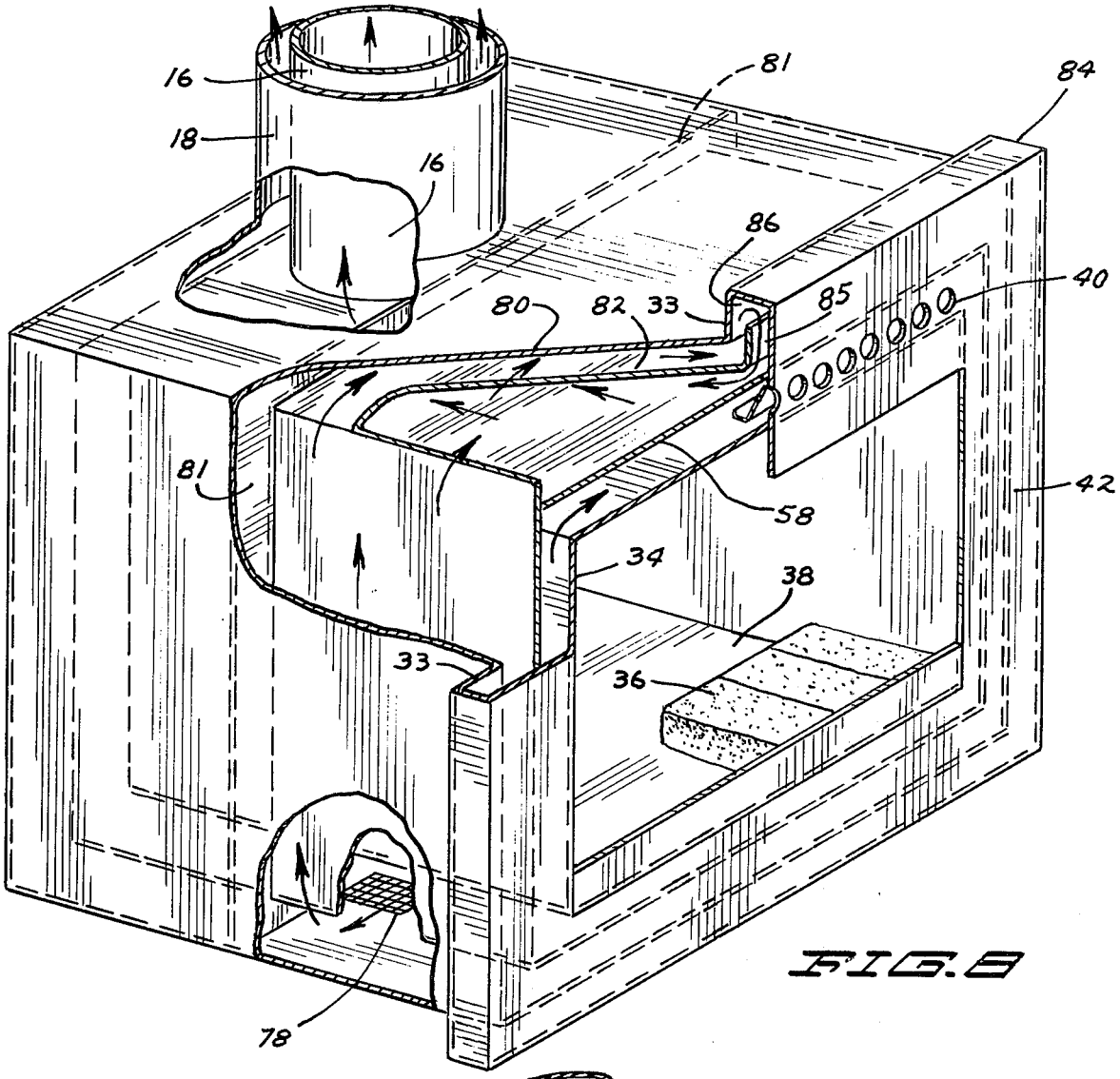
FIG. 8 is a fragmentary perspective view of the heating unit with portions of an outer casing, a smoke shelf, and an inner casing removed.
Figure 7:
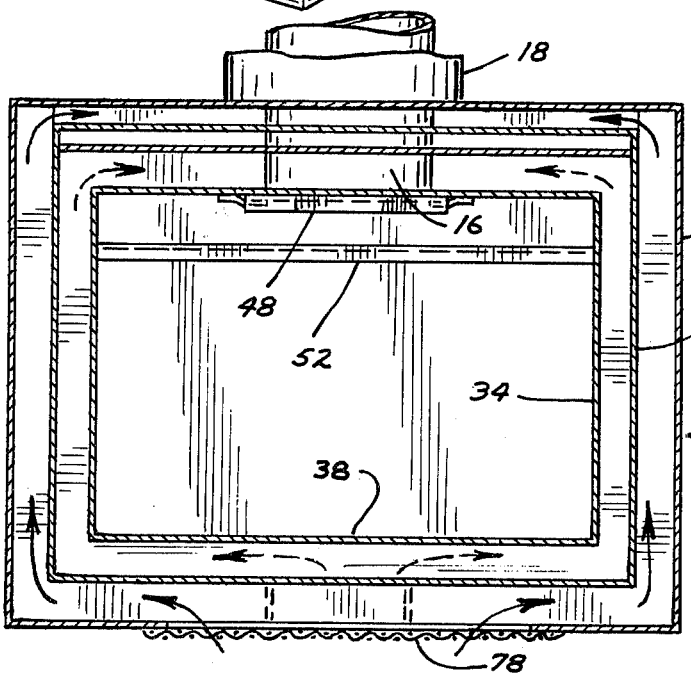
FIG. 7 is a cross sectional view as seen along line 7—7 in FIG. 3.

Heating unit 12 includes a firebox 34 located substantially in the center of the heating unit. Combustion in the firebox takes place over firebrick 36 which covers a floor 38 of the firebox, as suggested in FIG. 8. For clairty the firebrick has been omitted from the other views. A first casing means 58 is situated in spaced relation to the firebox 34 on all sides thereof except the face of the firebox which opens through wall 14 into the mobile home room. Here the first casing 58 and the firebox 34 integrally join, as by welding, a vertical heating unit face 42.

The space between first casing means 58 and the firebox 34 generally is designated as the inner passageway 56. A plurality of openings 40 are provided in the heating unit face 42 to open from this inner passageway 56 into the interior of the room in which the fireplace is installed. The stack 16 joins the top wall of firebox 34 to provide a flue opening 46 from the interior of the firebox to a flue 24 which is defined by the stack.

A second casing means 80 is situated in spaced relation outside of first casing means 58 substantially on all sides thereof with the exception of the face of the heating unit which opens through the wall 14. Here the second casing means 80 joins with the outer casing flange 33 which in turn is integral with an inwardly extending upper wall flange 84. It is this wall flange 84 which is integrally connected to the vertical heating unit face 42. The space between first casing means 58 and second casing means 80 and including the space between the outer casing flange 33 and the heating unit face 42, together with the space between the stack 16 and the stack casing 18 are designated generally as the outerpassageway 26. Cooling air inlet 78 is open through the bottom wall of second casing means 80 to provide access of air to inner passageway 56, and stack casing 18 is integral with and extends integrally upwardly from a top wall of the second casing means 80, and is open at the top to provide egress for air passing through the outer passageway 26 from inside of the second casing means back into the ambient atmosphere at the top of stack casing 18.

A short cylindrical collar 43 is integrally connected, as by welding, for example, through the bottom wall of the first casing means 58 and the bottom wall of the second casing means 80 to provide a heating air inlet 54 from outside of the mobile home room and into the inner passageway 56.

As shown, each of these inlets 78 and 54 may be conveniently covered by screens or hardware cloth to prevent the ingress of insects or small animals or other foreign objects.

The heat due to combustion in the firebox, as when any type of fire is burning therein, generates three simultaneous but separate air flow patterns: 1. A combustion air and combustion products flow; 2. A heating air flow; and 3. A cooling air flow.

1. Combustion Air and Products Flow

Combustion air enters firebox 34 through a lateral opening 44 through the vertical heating unit face 42. After combustion in a wood fire, a gas fire, or the like, this air and the products of combustion are drawn upwardly through flue 24 in stack 16, and this in turn draws more air for combustion through opening 44.

In the structure of the invention, it is highly desirable to extract as much heat as possible out of the products of combustion before they pass off through the stack. For this reason, a smoke shelf 52 extends integrally outwardly from a back wall of the firebox 34 in spaced relationship to flue opening 46. This shelf 52 is also in sealing relationship to the side walls of the firebox and extends forwardly to an intermediate position between the heating unit face 42 and said back firebox wall. This shelf insures that the products of combustion pass out of the firebox along the entire side by side width of the top wall of the firebox and do not simply pass out on a straight line to flue opening 46 as is the case when no smoke shelf is provided. This prevents hot spots from forming in the firebox near the flue opening 46, and insures that the point of lowest pressure within the firebox is along the leading edge of the smoke shelf, thus insuring that no smoke or other products of combustion will enter the room, but, perhaps more importantly, it provides for a wiping, heating action of these products of combustion on the upper wall of the firebox to substantially promote heat transfer from that wall to heating air passing through the inner passageway.

Figure 6:
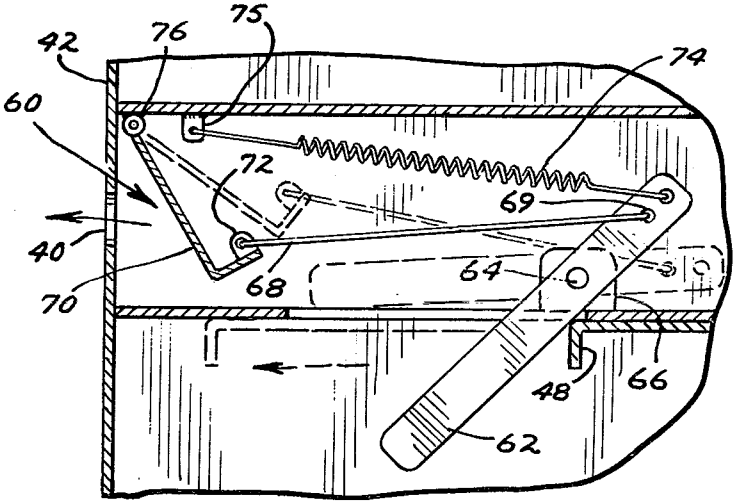
FIG. 6 is an enlargement of a fragment of the cross sectional view of FIG. 4.
Figure 4:
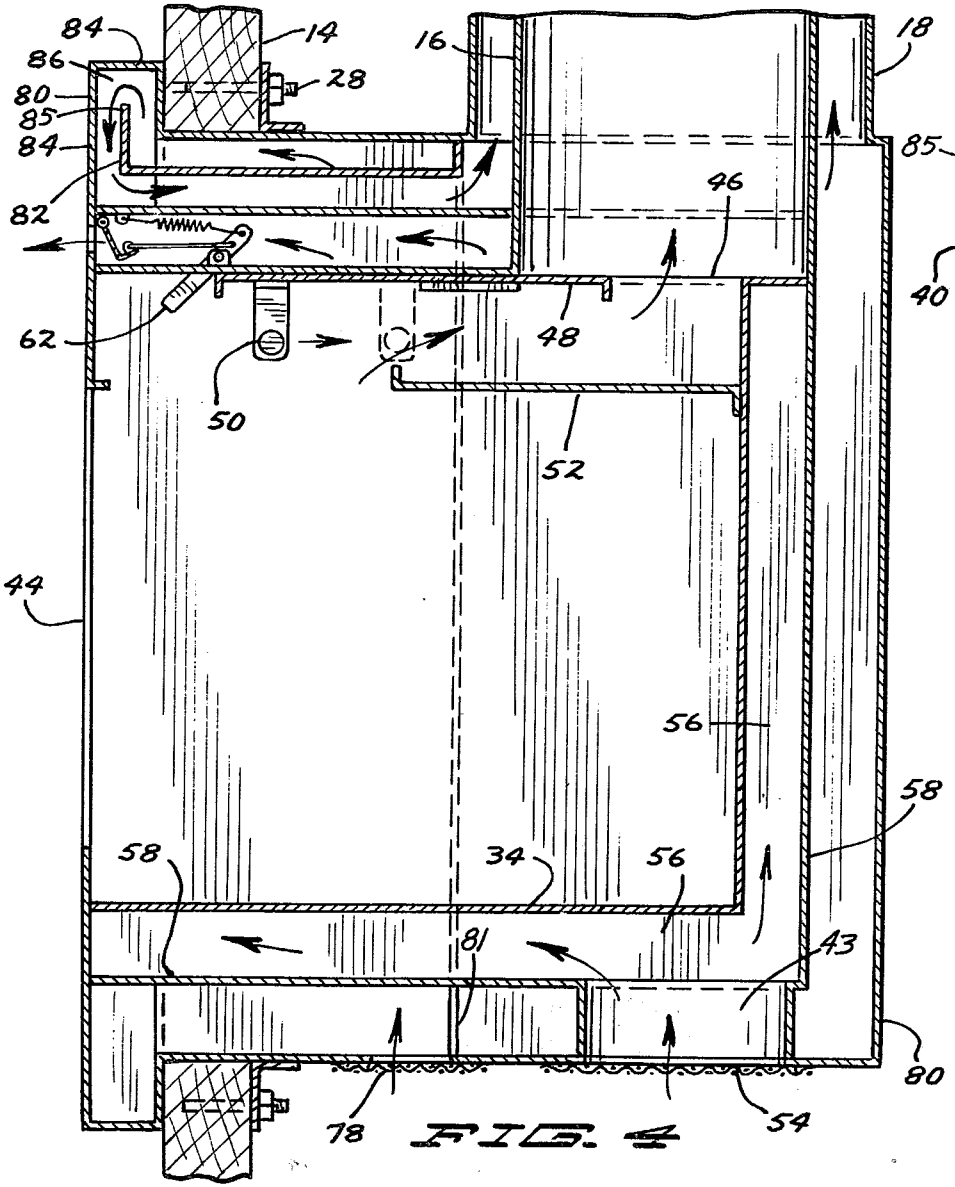
FIG. 4 is an enlarged cross sectional view as seen along 4—4 in FIG. 2.

A damper 48 is slidably mounted along the top wall of the firebox 34 to move from position as seen in FIG. 5 entirely closing off the flue opening 46 through position as seen in FIG. 4 and as seen in full lines in FIG. 6 to position as seen in dotted lines in FIG. 6 where it will be in clearing relation to the entire flue opening 46. This allows the complete shutoff of the firebox to the outside when the fireplace is not in use, thus preventing substantial heat loss. It also allows the damper to be moved through the instrumentality of a hand hold lug toward the closed condition as a fire is allowed to go out, thus cutting down the flow of air to a point where the products of combustion are all allowed to escape through the flue 24, but substantial waste heat loss is diverted. This damper 48, in combination with a heating air valve assembly 60 also insures the free access to flow of heating air through the inner passageway during use of the fireplace and insures cutoff of such flow at the time the fireplace is not in use, all in a manner to be subsequently explained.

2. Heating Air Flow.

The entire surface of the firebox 34 will be heated during combustion of a fire burning in it. After the fire has been burning for any appreciable length of time, this will even include the floor 38 under the firebricks 36. By conduction and radiation, this will cause the air in inner passageway 56 to be heated and to expand and thereby to rise around the floor 38, and the back and side walls of the firebox 34 where it will pass over the top wall of the firebox and out of the openings 40 in the vertical heating unit face 42. With no obstructions over the openings 40, and with the fireplace fire being a substantial one, sufficient heating air at a sufficient temperature is discharged through these openings that it is extremely uncomfortable if not impossible to continually position a hand or other part of the body within six inches of the openings on the interior of the wall 14.

Having come from the outside ambient atmosphere, this heated air is fully oxygen rich. The velocity at which it is discharged into the room will cause it to carry on through the room as it rises. As it cools, it will move down along the far side of the room and will be available in its turn to support combustion as it is drawn by the first air flow pattern through the opening 44 into the firebox.

3. Cooling Air Flow

Because of the heat of combustion within the firebox, and the heating of the heating air passing through the inner passageway 56, the walls of the first casing means 58 will also become more or less heated by radiation from the firebox walls and by convection of the heating air. The stack 16 will be very hot due to the passage of the products of combustion up through it, and so that portion of the air in outerpassageway 26 between the stack and the stack casing 18 will become heated. This will cause an expansion of such heated air, and a flow upwardly out of the top of the stack casing 18, thus inducing a flow of cooling air in through the cooling air inlet 78 in the bottom wall of the second casing means 80. As perhaps best seen in FIG. 8, a vertical cooling air separation plate 81 is rectilinear in shape, extends around the entire periphery of the first casing means 58 and is in integral sealing relationship with that casing means on the sides and bottom thereof, and is integral sealing relationship with respect to the second casing means 80 on the top and bottom and both sides thereof. A horizontal cooling air plate 82 is integral with the bottom edge of the top horizontal run of the vertical cooling air separation plate 81 and extends forwardly in parallel relationship with the top wall of the first casing means 58 and the second casing means 80 and is spaced approximately equally distant therefrom. Outer side edges of the horizontal cooling air plate 82 are in sealing relation to top edge extensions of the side walls of the first casing means 58. Along the edge of the horizontal cooling air plate 82 opposite its connection to cooling air separation plate 81, a vertically upstanding flange 85 is an integral part of plate 82 and is positioned to be halfway between the vertical heating unit face 42 and the outer casing flange 33. The top edge of this flange 85 stops short of upper wall flange 84 to provide a cooling air passage 86.

The induced cooling air flow through the outer passageway 26 caused by the heating of the air in that passageway is in the bottom of the heating unit 12 through cooling air inlet 78, around the bottom of the first casing means 58 and up the sides and across the top thereof in the area between the cooling air separation plate 81 and the outer casing flange 33. This flow is directed to the top surface of the horizontal cooling air plate 82, and passes over that surface tending to cool it, around the upstanding flange 85 on the outer edge of cooling air plate 82, down the other side of that flange and under the bottom surface of the cooling air plate 82, passing at the same time over the top wall of the first casing means 58, and from there, underneath of the top horizontal run of the cooling air separation plate 81 to the space between the first casing means and the second casing means to the rear of the vertical cooling air separation plate 81, and hence out of the space between stack 16 and stack casing 18.

It is noted that, as shown, the space between the first and second casing means behind the vertical cooling air separation plate 81 is virtually dead air space, as there is no positively induced air movement. This dead air space in itself acts as an insultor and has been found, in most instances, to be sufficient to keep the temperature of the outside surface of the first casing means 58 low enough so that damage or injury will not be caused by persons accidentally bumping into this portion of the heating unit when the fire is burning in the fireplace. In confined areas where further cooling is needed at the rear of the heating unit, openings can be provided similar to the cooling air inlet 78 either through the lower horizontal run of the vertical cooling air separation plate adjacent the cooling air inlet, or a separate cooling air inlet can be provided in the bottom wall of the second casing means 80 to the rear of the vertical cooling air separation plate.

It is to be noted that all areas of the heating unit 12 which come into contact with the wall 14 as well as all areas of that unit which extend outwardly of the firebox and into the room where they can be touched are insulated first by the flow of heating air through the inner passageway and secondly by the flow of cooling air through the outer passageway. The effect of cooling air flow on those portions of first casing means 58 which are subjected to such flow, and, more important, the effect of the heating air flow on the outside of all of the surfaces of the firebox 34 is to effectively prevent the burnout of similar deterioration of the casing means and the firebox. This effect is similar to the subjecting of a frying pan or a cooking utensil to a very high heat with water on the inside. Until the water boils completely dry, the pan will not be burned out by the strongest of cooking flames.

Similarly, as long as the openings 40 in the vertical heating unit face 42 and as long as the heating air inlet 54 are open, fire in the firebox will cause flow of air which will prevent serious damage or burnout regardless of the intensity of the fire in the firebox.

The aforementioned heating air valve assembly 60 is provided so that the openings 40 in the heating unit face 42 are always open whenever there is a fire in the firebox. This is done by interlocking the operation of the heating air assembly 60 with the damper 48.

When there is no fire in the fireplace, and the damper 48 is shut, the parts will be positioned as seen in FIG. 5. Before building a fire in the firebox 34, the damper 48 should be moved toward the open position; and if a fire builder forgets to open the damer, as soon as the smoke begins to collect in the firebox, he will immediately rectify this situation. As perhaps best seen in FIG. 6, a heating air valve 70 is pivotally mounted as at 76 in adjacent relationship to vertical heating unit face 42, and has an ear 72 extending upwardly from a bottom edge thereof. This ear is pivotally connected to a linkage rod 68 which in turn is pivotally connected as at 69 to a heating air lever 62. This heating air lever is pivotally mounted on a pair of upstanding lugs 66 as at 64, and a lower end of this lever extends through a provided slot in the top wall of the firebox 34.

When the damper is opened, it will first strike the lower portion of the heating air lever 62 and move it to a position as seen in full lines in FIG. 6 and as seen in FIG. 4. This, acting through the linkage rod 68, will move the heating air valve 70 into partial clearing relationship to openings 40 in face 42, thus insuring that at least some air will flow outwardly from the inner passageway through the openings 40 and into the mobile home room. Upon further movement of the damper to the position as seen in dotted lines in FIG. 6, for example, the heating air lever 62 will be farther moved, and the heating air valve 70 will move to the dotted position as seen in that figure. A tension spring 74 is fixedly mounted to the first casing means 58 as at 75, and the other end is hooked into the uppermost end of the heating air lever 62 thus to insure that the heating air valve 70 goes into closed relation with respect to the openings 40 upon the movement of the damper 48 back to closed position. Thus, since it is impossible to have a fire in the firebox without having the damper open, so it is impossible to have a fire in the firebox without insuring that there will be flow of heating air throughout the unit.

The cooling air inlet 78 and the top of the stack casing 18 are never closed, so there will always be occasion for flow of cooling air whenever there is sufficient heat in the firebox in the stack to draw the cooling air through the heating unit.

The embodiments of the invention in which an exclusive property or privilege is claimed are defined as follows:

1. A heating unit assembly for use in a closed structure having at least one upright wall provided with an opening therethrough, said heating unit assembly including a heating unit mounted in said opening and having a vertical heating unit face plate inside of said closed structure, said heating unit also including a firebox extending outwardly from said closed structure wall, said firebox being open to the interior of said closed structure through said heating unit face plate, and including a substantially horizontal upper wall, an open top stack providing a flue open to an upper portion of said firebox and extending vertically upward from said upper firebox wall to position outside of said closed structure and in spaced relation to said upright structure wall, a first casing means in surrounding, spaced relation to said firebox and in integral sealing relation to said heating unit face plate to provide an inner passageway between said firebox and said first casing means, a second casing means in surrounding, spaced relation to said first casing means and in sealing relation to said heating unit face plate to provide an outer passageway between said first and second casing means, an open top stack casing in surrounding spaced, concentric relation to the outside of said stack and open to position outside said structure, said stack casing being mounted on an upper portion of said second casing means so that the space between said stack and said stack casing is open to and forms a part of said outer passageway, there being a cooling air inlet through a bottom portion of said second casing means from outside said closed structure to said outer passageway, there being a heating air inlet conduit through said second casing means and open through a bottom portion of said first casing means from outside said closed structure to the inner passageway, and there being at least one heating air outlet provided through said heating unit face plate and opening from an upper portion of the inner passageway to the interior of said closed structure.

2. The assembly of claim 1 wherein said first casing means includes a substantially horizontal upper wall in spaced relation to said upper firebox wall.

3. The assembly of claim 2 wherein said second casing means includes a substantially horizontal upper wall in spaced relation to said first casing means upper wall.

4. The assembly of claim 3 and an upright cooling air separation plate between said first and second casings in sealing relation to bottom and side walls of each of said casings, there being a passage provided through said cooling air separation plate between the upper first casing wall and the upper second casing wall, at least a portion of said cooling air inlet being open through said lower portion of said second casing means on a side of said cooling air separation plate opposite that to which the stack casing is open.

5. The assembly of claim 4 wherein a substantially horizontal cooling air plate is in spaced relation between the upper walls of said first and second casing means, wherein said horizontal cooling air plate is in sealing relation to vertical side wall extensions of said first casing means and said upright cooling air separation plate and terminates in spaced relation to said heating unit face plate, said upright cooling air separation plate is in sealing relation to said upper wall of said second casing means, and wherein said passage through the cooling air separation plate is between the cooling air plate and the upper wall of said first casing means.

6. The assembly of claim 1 including an outer casing flange integral with the heating unit face plate and adapted for face-to-face contact with an inside surface portion of the structure wall, a collaring means adapted for face-to-face contact with an outside surface portion of the structure wall, and fastening means engageable with the outer flange and with the collaring means whereby each of the outer casing flange and the collaring means are held in pressing contact with its associated structure wall surface portion.

7. The assembly of claim 6 wherein the collaring means includes an angle iron flange circumjacent the second casing means portion proximate to the structure wall, said angle iron flange being slidable and substantially snug fitting with respect to said second casing means portion.

8. The assembly of claim 4;

a damper mounted inside of said firebox and movable between a closed position wherein said stack is entirely sealed off from the interior of the firebox and an open position wherein said damper is in clearing relation to said stack flue;

a normally closed heating air valve means movable between a closed position wherein said heating air outlet is completely blocked and an open position wherein said heating air outlet is open between said inner passageway and the interior of said structure; and positive means for moving said heating air valve means between closed position and open position.

* * * * *

UNITED STATES PATENT AND TRADEMARK OFFICE

CERTIFICATE OF CORRECTION

PATENT NO. : 4,003,362

DATED : January 18, 1977

INVENTOR(S) : JOSEPH H. LENER

It is certified that error appears in the above-identified patent and that said Letters Patent are hereby corrected as shown below:

Column 1, line 33, "Np." should be --No.--.

Column 3, line 27, "clairty" should be --clarity--.

Column 6, line 12, "insultor" should be --insulator--.

Column 8, line 40, after "outer", insert --casing--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*